US005834996A

United States Patent [19]

Ullermann

[11] Patent Number: 5,834,996

[45] Date of Patent: Nov. 10, 1998

[54] ELECTRIC SWITCH HAVING UNDERVOLTAGE TRIPPING

[75] Inventor: Wolfgang Ullermann, Schwabach, Germany

[73] Assignee: Ellenberger & Poensgen GmbH, Altdorf b.Nuremberg, Germany

[21] Appl. No.: 843,398

[22] Filed: Apr. 15, 1997

[30] Foreign Application Priority Data

Apr. 18, 1996 [DE] Germany ..... 296 07 027 U

[51] Int. Cl.[6] ..... H01H 75/00

[52] U.S. Cl. ..... 335/6; 335/20; 335/18; 335/114; 335/115; 335/132; 335/185; 335/186; 335/190

[58] Field of Search ..... 335/6, 20, 185, 335/186, 189, 190, 114, 115, 132, 18

[56] References Cited

U.S. PATENT DOCUMENTS

| | | | |
|---|---|---|---|
| 4,034,266 | 7/1977 | Virani et al. | 361/42 |
| 4,329,669 | 5/1982 | Krasser et al. | 335/20 |
| 4,570,142 | 2/1986 | Ineichen et al. | 337/66 |
| 5,184,101 | 2/1993 | Ineichen et al. | 335/7 |
| 5,491,460 | 2/1996 | Krasser et al. | 337/70 |
| 5,558,211 | 9/1996 | Heydner et al. | 200/553 |

FOREIGN PATENT DOCUMENTS

| | | |
|---|---|---|
| 04598190 | 11/1991 | European Pat. Off. . |
| 2809754 | 10/1978 | Germany . |
| 2928277 | 1/1981 | Germany . |
| 3340250 | 5/1985 | Germany . |
| 3114717 | 4/1987 | Germany . |
| 4341214 | 6/1995 | Germany . |
| 607314 | 11/1978 | Switzerland . |
| 94/07255 | 3/1994 | WIPO . |

*Primary Examiner*—Michael L. Gellner
*Assistant Examiner*—Tuyen T. Nguyen
*Attorney, Agent, or Firm*—Spencer & Frank

[57] ABSTRACT

An electric switch (1) includes a switching device (4), movable between its ON position and OFF position, for switching a current circuit. The switch (1) is combined with a magnetic circuit (28, 29) for electromagnetic undervoltage tripping. In the event of undervoltage, the magnetic circuit (28, 29), as it opens, shifts the switching device (4) to its OFF position. The switching device (4) shifted to its OFF position closes the magnetic circuit (28, 29) again. A linearly movable fixing slide (24) couples the switching device (4) with the magnet armature (28) of the magnetic circuit and fixes the magnet armature (28) on the magnet core (29) in the OFF position of the switching device (4).

16 Claims, 8 Drawing Sheets

ELECTRIC SWITCH HAVING UNDERVOLTAGE TRIPPING

BACKGROUND OF THE INVENTION

The invention relates to an electric switch having a switching device, movable between an ON position and an OFF position, for switching a current circuit on and off and having a magnetic circuit for electromagnetic undervoltage tripping, the magnetic circuit includes a magnet armature and a magnet core, wherein upon undervoltage, the magnetic circuit as it opens shifts the switching device to its OFF position, and wherein the switching device shifted into its OFF position closes the magnetic circuit.

Switches of this kind are known from German Published Patent Applications DE-A 4 341 214 and DE-A 3 340 250. These switches cooperate with a magnetic circuit for electromagnetic undervoltage tripping. If the monitored voltage drops below a certain value, the magnetic circuit is opened, and consequently a manually actuatable switching device is shifted to its OFF position. In this OFF position, the current circuit of the electric switch is interrupted. The switching device is coupled to the movable magnet armature of the magnetic circuit in such a way that when the switching device is in the OFF position, the magnetic circuit is automatically closed again. As a result, the magnetic circuit is closed again even without the presence of the requisite minimum voltage. Hence the electromagnet needs to generate only the retention force required for the magnet armature when the magnetic circuit is closed. This retention force is substantially less than the attraction force for closing the magnetic circuit when voltage is again present.

A disadvantage of the known switches is the structurally complicated coupling between the switching device and the magnet armature. The switching motion of the switching device from its ON position to its OFF position is transmitted to the magnet armature via complicated pivot lever constructions. This coupling makes it more complicated to manufacture the components required for the undervoltage tripping and increases the production costs. Moreover, the complicated pivot lever constructions allow only a relatively slight transmission of force between the switching device and the magnet armature. Even slight wear of these pivot levers can impair the proper sequence of function in the undervoltage tripping. To counteract this, it is admittedly possible for individual coupling components to be made larger. However, this demands increased space for the switch housing and/or a housing provided for the magnetic circuit.

SUMMARY OF THE INVENTION

The object of the invention is to improve an electric switch of the type described in more detail at the outset in terms of its construction and safety.

According to the invention, the switching device is coupled to the magnet armature of the magnetic circuit by a linearly movable fixing slide for fixing the magnet armature to the magnet core in the OFF position of the switching device. The translational motion of the fixing slide enables an especially space-saving construction of the coupling required between the switching device and the magnet armature. This has an equally space-saving effect on the dimensioning of the switch housing and on an optionally provided housing for the magnetic circuit. Moreover, the fixing slide that is linearly movable in its displacement direction has the effect that the forces exerted on the fixing slide by the switching device in the OFF position can be transmitted effectively, essentially in the displacement direction, directly to the magnet armature. As a result, the switching device need bring to bear only relatively slight forces in order to displace the magnet armature into its attracted position on the magnet core and fix it there. Preferably, one contact face of the magnet armature is in direct contact with one or more pole faces of the magnet core. This contacting is typically effected counter to the spring pressure of a compression spring disposed between the magnet armature and the magnet core and acting in the dropping direction of the magnet armature. The good force transmission, brought about by the fixing slide, from the switching device to the magnet armature also promotes a design of the switching device which is simple in terms of construction as well as its stability during the period of operation of the switch. Preferably, the fixing slide is supported displaceably toward the housing, and incorrect motions and incorrect force transmissions between the switching device and the magnet armature are reliably avoided.

In a preferred embodiment, the voltage to be monitored, which is connected to the electromagnet, is the mains voltage for the current circuit of the electric switch. In principle, the electromagnet may also be connected to some other voltage. In another preferred embodiment, the electromagnet is connected to two phases of a multiphase current system. Here the undervoltage unit is preferably combined with a two-pole switch. The electric switch, in a preferred embodiment, is embodied as an excess current protection switch and to that end has one corresponding excess current tripping member per phase, the member in particular being a bimetal strip acting on a breaker mechanism of the circuit breaker.

The undervoltage unit with the magnetic circuit can be built into the switch housing or integrated into a separate housing that is coupled to the switch housing by suitable fastening means.

Preferably, the coil terminals of the electromagnet are electrically conductively connected via a rectifier to the contact terminals of the undervoltage unit that are connected to the voltage that is to be monitored. By means of the electromagnet operated with direct current, the irritating "hum" is avoided. This makes it unnecessary to have a complicated design and machining of the pole faces of the electromagnet for hum reduction. In another advantageous feature, a series resistor is inserted into the electric circuit between the coil terminals of the electromagnet and the contact terminals that are connected to the voltage to be monitored. This series resistor reduces the power consumption of the coil winding and makes a less power loss of the electromagnet in long-term operation possible.

In a preferred feature, the switching device is complicated as a two-armed operating rocker, which is pivotably supported on the switch housing. While the rocker is pivoting into its OFF position, its pivoting motion is converted directly into a translational motion of the fixing slide. In another embodiment, the switching device is embodied as one or two pushbuttons, on which the user exerts pressure manually to actuate them, thus displacing them longitudinally. The longitudinal motion of the pushbutton preferably extends parallel to the translational motion of the fixing slide, so that the pushbutton and the fixing slide can be coupled especially simply.

The switching device is converted to its OFF position when freely tripped, for instance by excess current or undervoltage, and upon manual operation. From the OFF position of the switching device (=interrupted current circuit), the switch typically, for safety reasons, cannot be turned back on again if the voltage monitored by the undervoltage unit does not suffice to keep the magnet armature in its attracted position on the magnet core. In the attempt nevertheless to shift the switching device to its ON position, the magnetic circuit is opened, and the automatic sequence for turning the switch back of again enclosing the magnetic circuit is set into motion. This automatic sequence if an attempt is made to shift the switching device on its ON position contributes to meeting the safety requirements made of the switch.

Preferably, the fixing slide and the switching device are connected to one another in such a way that the fixing slide is decoupled from the switching device in the ON position thereof. In that case, the fixing slide and the magnet armature are freely movable relative to the switching device. This free mobility assures reliable free tripping of the switch in the event of undervoltage. Moreover, the decoupling of the switching device and the fixing slide reinforces the aforementioned sequence if an attempt is made despite negative voltage to shift the switching device into its ON position.

In a preferred embodiment, the fixing slide has a bearing shoulder extending crosswise to its displacement direction. In the event of undervoltage, that is, if the magnet armature is dropping, the fixing slide is displaced and acts upon a breaker mechanism connected to the switching device. The breaker mechanism is movable between a contact opening position and a contact closing position in order to open and close a switch contact of the current circuit, and when the switch contact opens, the breaker mechanism shifts the switching device to its OFF position. In this way, upon undervoltage tripping, the fixing slide assures a technically simple, automated sequence for interrupting the current circuit and reclosing the magnetic circuit. For tripping this automatic sequence, that is, the action upon the breaker mechanism, no other components besides the fixing slide itself are necessary. This contributes to a space-saving and technically simple design of the electric switch and of the undervoltage unit.

In a preferred embodiment, a spring element is disposed between the fixing slide and the magnet armature. Its spring force can compensate for production-dictated dimensional tolerances and deviations of the switching device, fixing slide and magnet armature, and thereby assures the safe mode of operation of the switch. Because of the compensating effect of the spring element, the proportion of rejects in the manufacture of these components also becomes less, thus further reducing the production costs of the electric switch and the undervoltage unit.

The compensating spring element is preferably embodied as a spring disk curved in an arc, with a concave side toward the magnet armature. The spring element is advantageously braced on the magnet armature, in particular on its end face toward the fixing slide, and as a result is fixed without additional aids between the fixing slide and the magnet armature. Moreover, the spring disk can be integrated in a space-saving way between the fixing slide and the magnet armature and assures an especially effective transmission of the spring force to the fixing slide in the displacement direction thereof.

In an advantageous embodiment, the magnet armature is connected in captive fashion to the fixing slide. This creates a mechanically particularly stable coupling in terms of the drive between the two components. Defective function sequences for opening and closing the magnetic circuit are therefore avoided from the very outset. The captive coupling is achieved for instance by means of a positive or a material-joining connection. The coupling may be rigid or movable.

In a preferred embodiment, the magnet armature is penetrated approximately crosswise to its end face toward the fixing slide, by an armature slit. This armature slit receives a fixation tang disposed on the fixing slide. Preferably, the fixation tang is an integral component of the fixing slide and as a result, it reinforces a mechanically stable coupling between the fixing slide and the magnet armature. The fixation tang is preferably connected to the magnet armature in the manner of a positive connection and thereby makes it simpler to assemble the components. The fixing slide penetrates the magnet armature from the fixing slide in the direction of the contact face of the magnet armature toward the magnet core. There, the fixation tang, in an advantageous feature, engages the edge of the armature slit. To that end, a crossbar is formed onto the fixing slide in a preferred embodiment and protrudes from the edge of the armature slit toward the contact face, in the assembled state of the fixation tang. The fixation tang and its associated crossbar are in particular T-shaped. To couple the fixation tang especially stably to the magnet armature, the armature slit is in the form of a cross slit with two intersecting longitudinal slits of different lengths. The two longitudinal slits are dimensioned such that the T-shaped fixation tang is first inserted into the longer longitudinal slit and is passed through this longitudinal slit with the crossbar and then rotated by 90° to lock in detent fashion into the short longitudinal slit. In this way, the fixing slide is additionally supported on the magnet armature in a manner secure against relative rotation and thus is even better protected against undesired changes of position.

If the aforementioned compensating spring element is disposed between the fixing slide and the magnet armature, then the fixation tang, in an additional function is operative as a centering and fixing element for this spring element. Without further aids, this spring element is supported in captive fashion on the fixation tang. To that end, the spring element is embodied as a helical spring, for instance, and surrounds the fixation tang with slight radial spacing. Being embodied as the spring disk, the spring element is penetrated, crosswise to the plane of the disk, by a slit for receiving the fixation tang and as a result is likewise supported in captive fashion. To further reduce the space required by the components of the switch and of the undervoltage tripping unit, and to reinforce proper functioning of the fixing slide with only slight coupling forces, the displacement direction of the fixing slide, in a preferred embodiment, extends parallel to the direction in which the magnet armature drops. Preferably, the displacement direction of the fixing slide is at the same time in the plane of motion of the switching device.

To simplify the manufacture of the fixing slide, in a preferred embodiment it is embodied in the form of a plate, and the plane of the plate is defined approximately by the displacement direction and a crosswise direction extending crosswise to it. This simple design makes it possible to manufacture the fixing slide as an economical mass-produced item. This fixing slide can advantageously be manufactured as a stamped part stamped from a suitable plastic or metal. Moreover, the plate shape of the fixing slide enables further miniaturization of the switch and/or the undervoltage unit.

In a further preferred feature, the coil body that carries the coil of the electromagnet has at least two guide webs that protrude past the pole face of the magnet core in the dropping direction of the magnet armature and extending approximately in the dropping direction. These guide webs are disposed facing one another and laterally flank the magnet armature to act as motion guides. This assures that the magnet armature executes controlled motions in the dropping direction and in the direction of its attracted position. This contributes to an absence of undesired position changes for the drive-coupling components of the electric switch and undervoltage unit. Moreover, these guide webs are effective indirectly as a motion guide for the fixing slide coupled to the magnet armature. As a result, a simple motion guide for the fixing slide is also created for the case where its displacement direction and the direction of motion of the magnet armature extend parallel to one another. In particular, the guide webs are an integral component of the coil body, which is injection-molded or cast from a suitable plastic.

To limit the dropping motion of the magnet armature and the linear motion of the fixing slide in the displacement direction to a suitable extent, one stop dog is disposed on each of the facing insides of the guide webs. The stop dogs extend crosswise to the crossing direction of the magnet armature and are aimed at one another. These stop dogs are preferably an integral component of the guide webs and thus are simple to manufacture.

In an advantageous feature, the electromagnet of the magnetic circuit has a horseshoe- or U-shaped magnet core. The free ends of the two legs of the U of the magnet core each have one pole face, which are contacted with the contact face of the magnet armature when the magnetic circuit is closed.

Typically, the coil body that carries the coil of the electromagnet is in multiple parts for the sake of simple assembly of the electromagnet, and so that it can receive the magnet core. It is advantageous in this respect for the coil body to be made in two parts, with the dividing plane as the plane of symmetry. In that case, only a single component need be manufactured for assembling the coil body. This is favorable from a manufacturing standpoint and makes for economical production of the electromagnet.

By means of suitable recesses, grooves and shaping of the coil body, the magnet core is fixed on the coil body. The plane of the U of the horseshoe-shaped magnet core, in an advantageous feature is located approximately in the dividing plane of the coil body. As a result, the magnet core is fixed by clamping, without additional fixing means, between the two parts of the coil body that act as clamping jaws. In a preferred embodiment, the two parts are joined together in captive fashion by mutual detent engagement, latching, or the like. This connection facilitates the further assembly of the electromagnet and the magnet core.

A separate device housing is preferably provided for the undervoltage unit. The coil body of the electromagnet is inserted into this device housing, where it is expediently fixed releaseably. To simplify the manufacture of the device housing, the coil body has a plurality of spring hooks, which in the assembled state protrude past an insertion opening in the device housing and correspond with matching detent recesses in the circuit breaker housing. No further fastening means for mounting on the switch housing therefore need to be taken into account on the device housing. The device housing can therefore be manufactured especially economically, for instance as a parallelepiped receiving shaft or the like. Conversely, taking the spring hook on the coil body into account has not such a pronounced effect on the cost, since the shaping of the magnet core and optionally the guide webs for the magnet armature must be taken into account anyway for the coil body.

In the assembled position of the coil body and the other components inside the device housing, the housing is naturally sealed off from the outside, for safety reasons. To that end, the switch housing is preferably used in an additional function for sealing purposes. The detent recesses that cooperate with the spring hooks are then arranged such that an outer face of the switch housing, when the spring hooks are in their detent position, automatically covers the insertion opening of the device housing. It is therefore possible to save costs by dispensing with separate sealing means for sealing off the undervoltage unit in the assembled state.

BRIEF DESCRIPTION OF THE DRAWINGS

The subject of the invention will be described in further detail below in terms of the exemplary embodiments shown in the drawings. Shown are.

DESCRIPTION OF THE PREFERRED EMBODIMENTS

Figure 1:
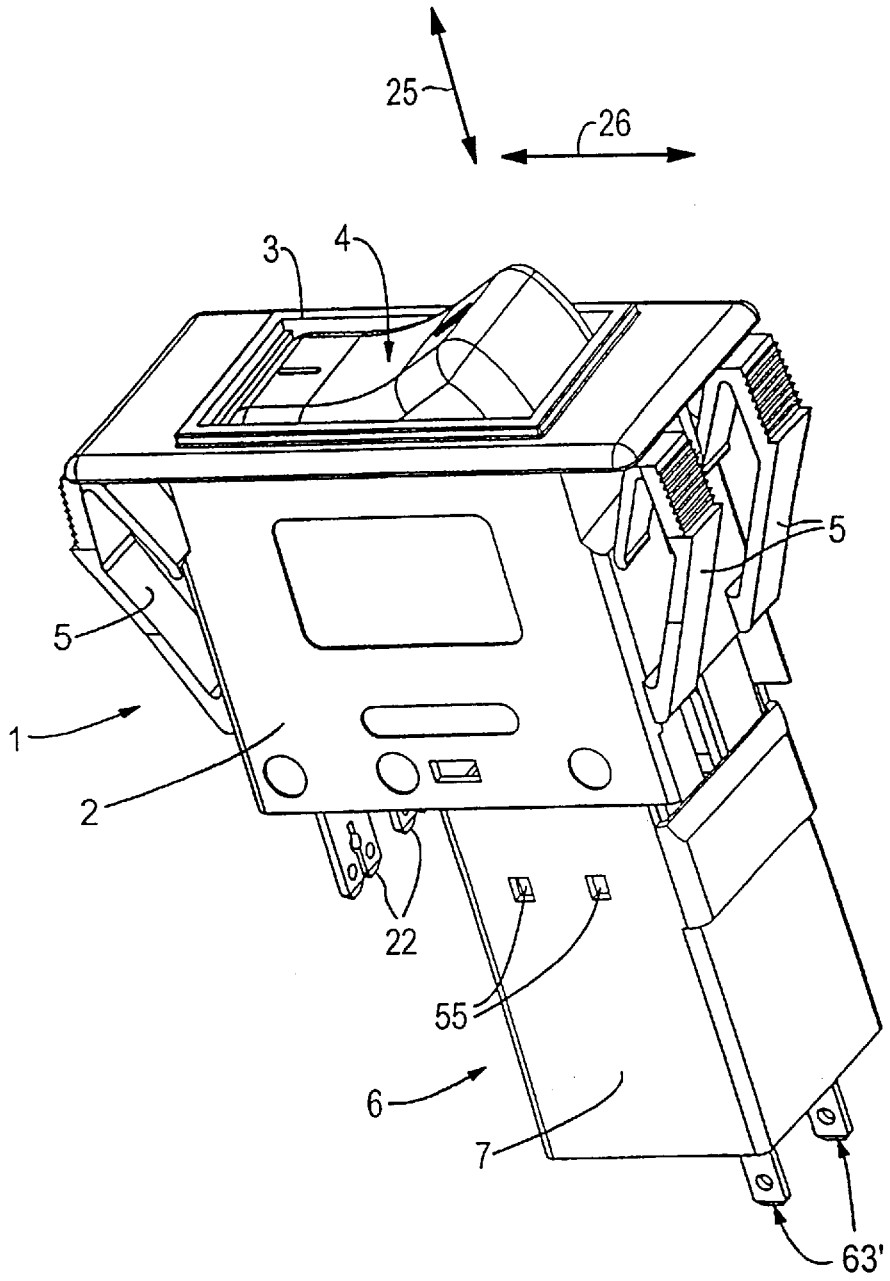
FIG. 1, a perspective view of an excess-current circuit breaker having an undervoltage device secured to it.

The electric switch is embodied as a two-poled excess current circuit breaker 1—hereinafter merely "circuit breaker 1" for short. Its switch housing 2, made of insulating plastic, has a rectangular housing opening 3, which is penetrated by a switching device in the form of a two-armed operating rocker 4. In FIG. 1, the rocker 4 is in its ON position, in which the current circuits of the two phases of the circuit breaker 1 are closed. The rocker 4 is pivotable between its ON position and an OFF position that interrupts the current circuits. Formed onto each of the two narrow sides of the switch housing 2 are two resilient housing hooks 5, of which only three housing hooks 5 are visible in FIG. 1. They serve to secure the circuit breaker 1 to a front panel, not shown here.

The rocker 4 cooperates with a breaker mechanism or switch mechanism for opening and closing switch contacts of the current circuits and with a magnetic circuit for the electromagnetic undervoltage tripping. The magnetic circuit is a component of a undervoltage device 6, whose device housing 7 is secured in the assembled position on the switch housing 2.

Figure 3:
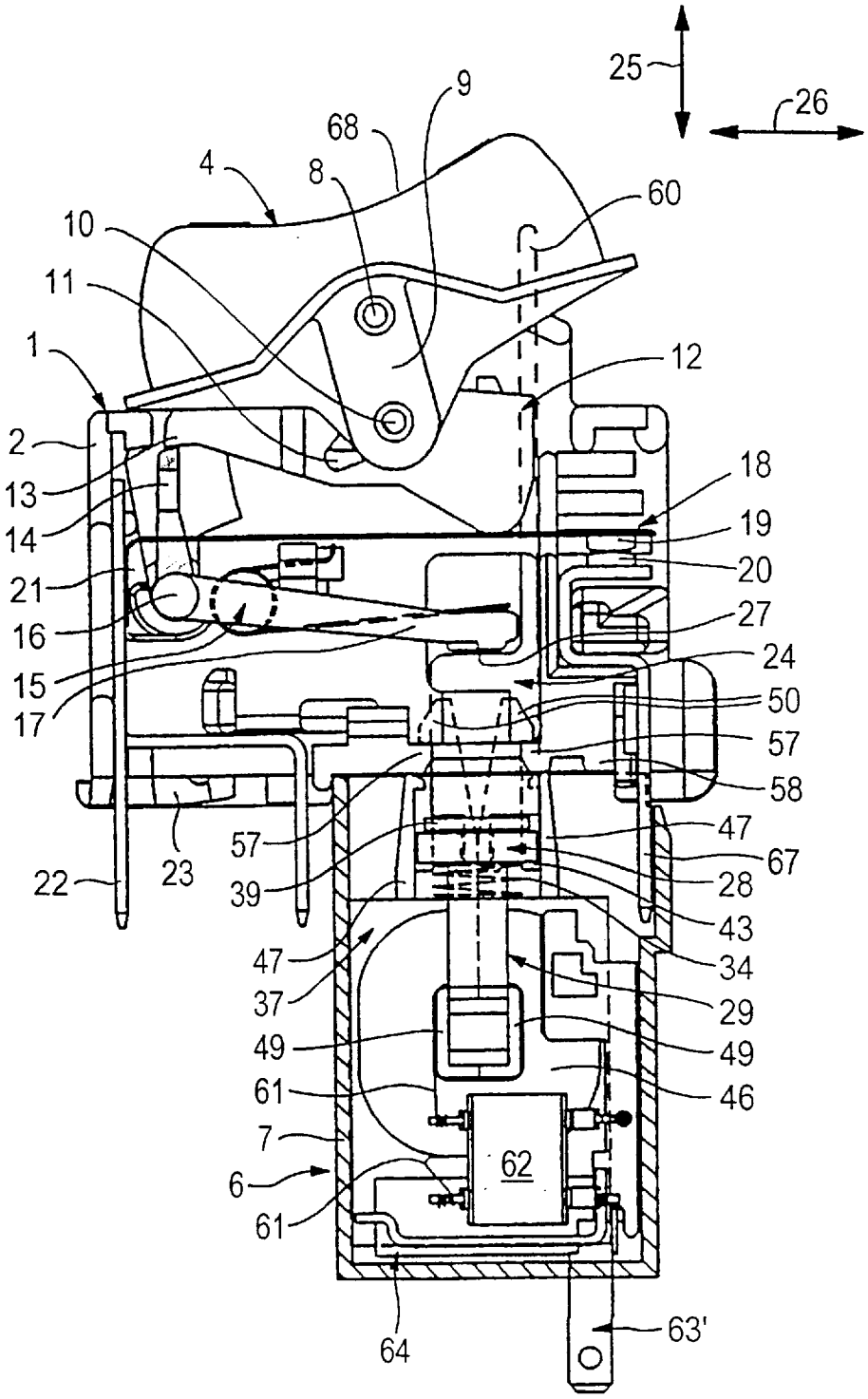
FIG. 3, a side view, partly in section, of essential components of the excess-current circuit breaker and undervoltage device of FIG. 1, with the magnetic circuit closed and with a switching device in the ON position.
Figure 4:
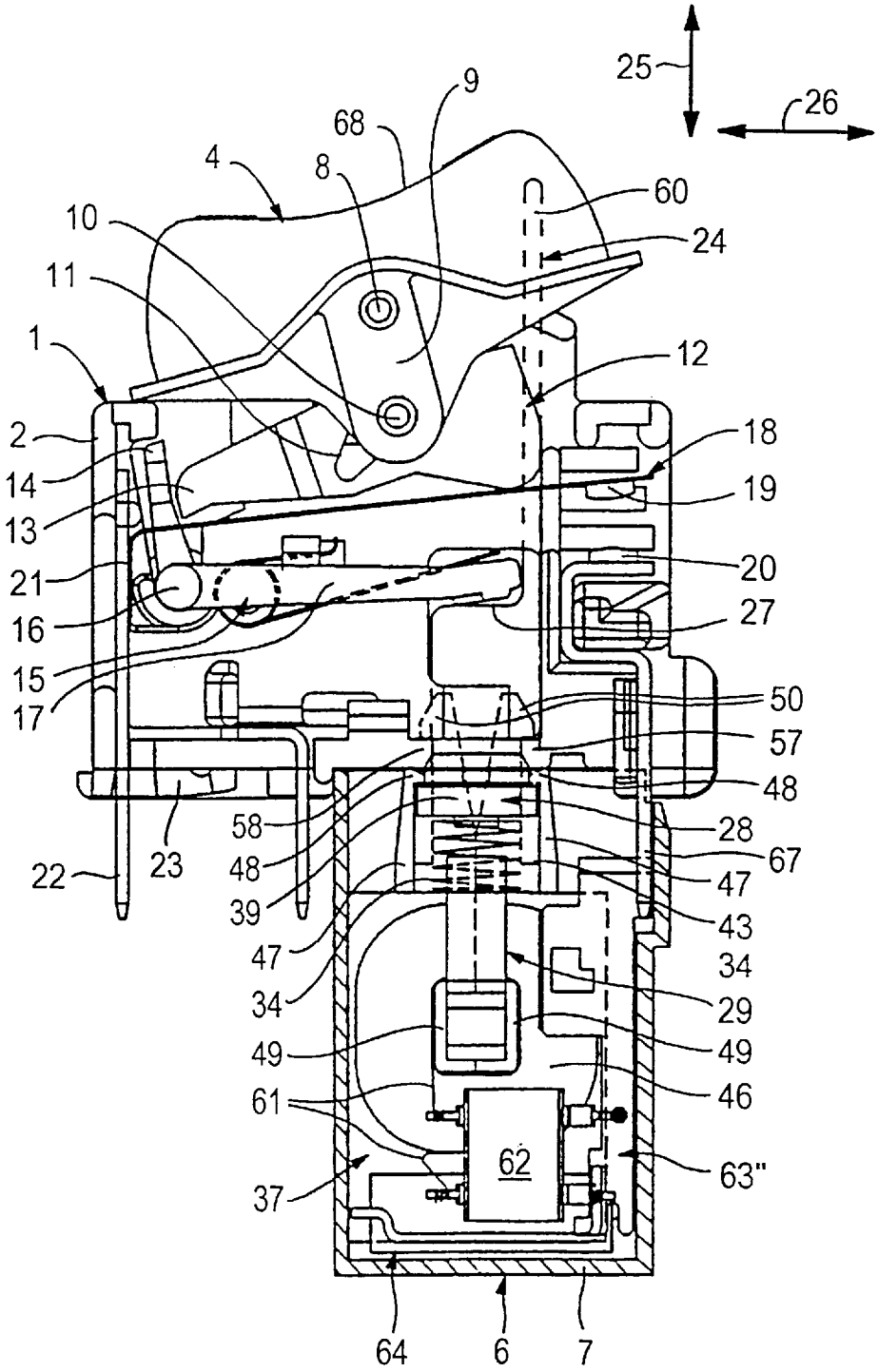
FIG. 4, the side view of FIG. 3 with the magnetic circuit opened and with the switching device still in its ON position.
Figure 5:
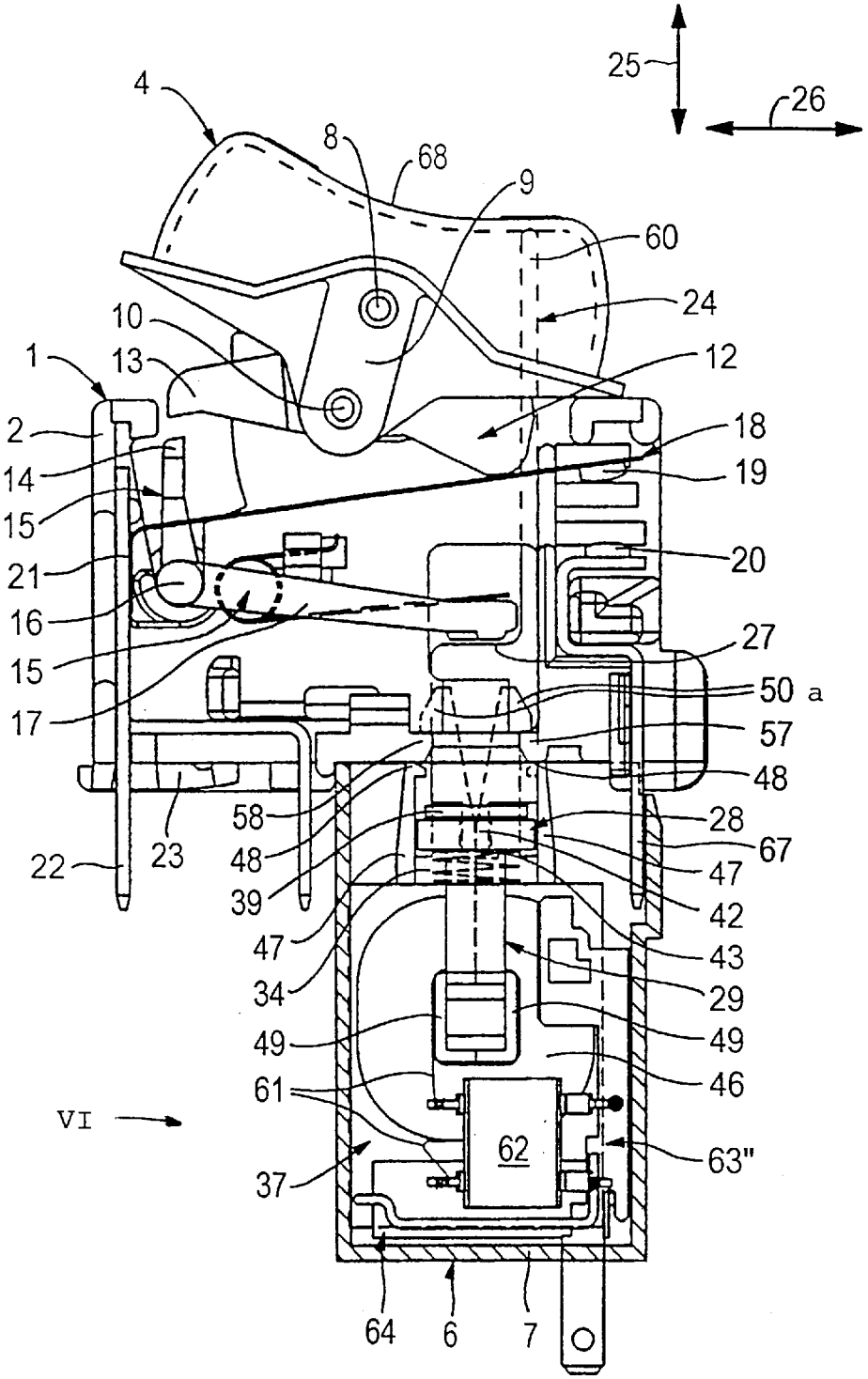
FIG. 5, the side view of FIG. 3 with the switching device in its OFF position and with a re-closed magnetic circuit.

The basic construction and mode of operation of the circuit breaker 1 is described in German Patent DE-C 2 928 277. The rocker 4 is pivotably supported on a pivot shaft 8 structurally connected to the housing (FIG. 3). Secured to an operative end 9 of the rocker 4 toward the switch mechanism is a coupling cam 10, which extending crosswise to the pivoting plane of the rocker 4 penetrates a cam path 11 of a latching lever 12 (FIG. 3). The latching lever 12 is supported by a support dog 13, disposed on its free end, on a lever arm 14, extending approximately vertically in the plane of the drawing, of a two-armed tripping lever 15. The tripping lever 15 is pivotably supported by means of a spindle holder 16 on a housing spindle extending parallel to the pivot shaft 8. The second lever arm of the tripping lever, namely a tripping arm 17, that is disposed approximately at right angles with respect to the lever arm 14 is acted upon in the event of excess current by a bimetal, not shown here, causing the tripping lever 15 to be pivoted counterclockwise. As a result, the latching lever 12 comes unlatched from the tripping lever 15 and as a result shifts the rocker 4 into its OFF position (this takes place in principle in the sequence shown in FIGS. 4 and 5). The unlatched latching lever 12 stops exerting pressure on a contact spring 18, which pivots counterclockwise and as a result separates a switch contact 19, secured to its free end, from a fixed contact 20 fixed inside the switching housing 2 (FIG. 4, FIG. 5). As a result, the current circuit of the pole of the circuit breaker 1, the pole being shown in the plane of the drawing in FIG. 3 through FIG. 5, is interrupted. The breaker mechanism of both poles of the circuit breaker 1 are connected to one another, or replaced by a single breaker mechanism, in such a way that the current circuits of both poles are always simultaneously closed or interrupted. Fastening end 21 of spring contact 18 is remote from the switch contact 19. The contact spring 18 is welded to a contact tongue 22. This contact tongue 22 is fixed in stationary fashion in the switch housing 2 and protrudes past one bottom side 23 of the switch housing 2, so that it can be connected in a known manner to the associated current circuit.

Figure 2:
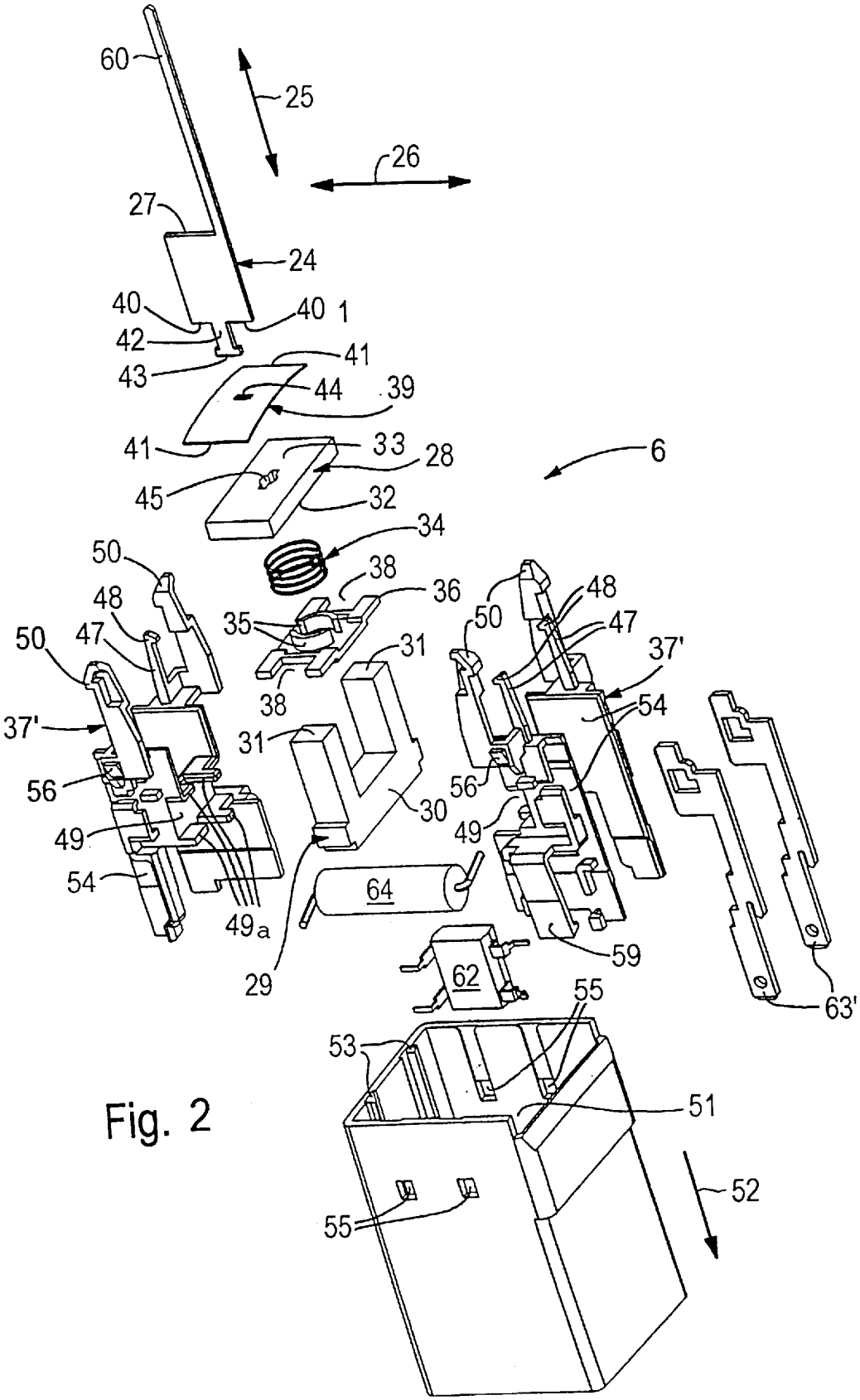
FIG. 2, an exploded view of essential components of an undervoltage device according to the invention.

The rocker 4 and the breaker mechanism of the circuit breaker 1 are coupled to one another by the magnetic circuit of the undervoltage device 6 via a fixing slide 24 shown particularly clearly in FIG. 2. The functional principle of the coupling will be described in detail hereinafter. In the assembled state, the fixing slide 24 is linearly movable or displaceable inside the switch housing 2 and the device housing 7. The displacement direction 25 extends in the direction of its longitudinal extent. The fixing slide 24 is a platelike component, the plane of whose plate is defined by the displacement direction 25 and by a crosswise direction 26 extending crosswise to it. The fixing slide 24 has a bearing shoulder 27, which extends in the crosswise direction 26 and which urges the tripping arm 17 of the tripping lever 15 counterclockwise when the magnetic circuit opens and thus moves the breaker mechanism into its contact opening position (FIG. 4). In this contact opening position of the breaker mechanism, the current circuit is interrupted.

The magnetic circuit includes a platelike magnet armature 28 and a horseshoe-shaped or in other words U-shaped magnet core 29. The two legs of the U of the magnet core 29 are joined together by a connecting yoke 30 and have one pole face 31 on each of their free ends. The pole faces 31, when the magnetic circuit is closed, are contacted directly with a contact face 32, facing toward them, of the magnet armature 28. The contact face 32 and an opposed end face 33, toward the fixing slide 24, of the magnet armature 28 are disposed at right angles to the displacement direction 25 of the fixing slide 24 in the assembled state. When the magnetic circuit is closed, the contact face 32 is held against the pole faces 31, counter to the spring pressure of a helical spring 34. The helical spring 34, disposed in the middle between the two legs of the U of the magnet core 29, positively surrounds a centering mandrel 35 with one axial spring end, and the other axial spring end acts upon the contact face 32. The centering mandrel 35 is formed onto the surface, toward the magnet armature 28, of a support bearing 36 disposed approximately crosswise to the displacement direction 25. The support bearing 36 is braced, in an assembled state, against a coil body 37 to be described in further detail hereinafter. To allow the support bearing 36 to be integrated in an especially space-saving way, it has two bearing grooves 38, facing one another, which in the assembled state each positively encompass one leg of the U of the magnet core 29.

Disposed between the fixing slide 24 and the magnet armature 28 is a spring element in the form of a spring disk 39 curved in an arc. The spring disk 39, with its convex side, touches a support edge 40 of the fixing slide 24 extending in the crosswise direction 26. In an assembled state, the spring disk 39 is braced with its two disk edges 41 extending in the crosswise direction 26 against the end face 33 of the magnet armature 28. The spring disk 39, prestressed in the direction of the support edge 40, creates a compensation in the displacement direction 25 for production-dictated dimensional differences of the fixing slide 24 and magnet armature 28.

By means of a fixation tang 42 protruding past the support edge 40 in the displacement direction 25, the magnet armature 28 is connected in captive fashion to the fixing slide 24. The fixation tang 42, of T-shaped cross section, has a crossbar 43 extending in the crosswise direction 26 on its free end toward the magnet armature 28. In the assembled state of the fixing slide 24, the fixation tang 42 penetrates a central longitudinal slit 44 of the spring disk 39 in the displacement direction 25 as well as a cross-slitlike armature slit 45 of the magnet armature 28. The armature slit 45 is formed by a first longitudinal slit and a shorter longitudinal slit that intersects it. For assembly, the crossbar 43 is passed through the longer longitudinal slit of the armature slit 45. Once the crossbar 43 protrudes past the contact face 32, the fixing slide 24 is rotated 90°, so that the fixation tang 42 locks in detent fashion into the shorter longitudinal slit of the armature slit 45. The crossbar 43 engages the edge of the armature slit 45 from behind and is pressed against the contact face 32 by the spring disk 39 that presses against the support edge 40. With the aid of the fixation tang 42, the fixing slide 24, spring disk 39 and magnet armature 28 are mechanically stably connected.

The displacement direction 25 of the fixing slide 24 extends parallel to the direction of motion (=dropping direction) of the magnet armature 28 and is simultaneously located in the plane of motion of the rocker (FIG. 3 through FIG. 6).

Figure 6:
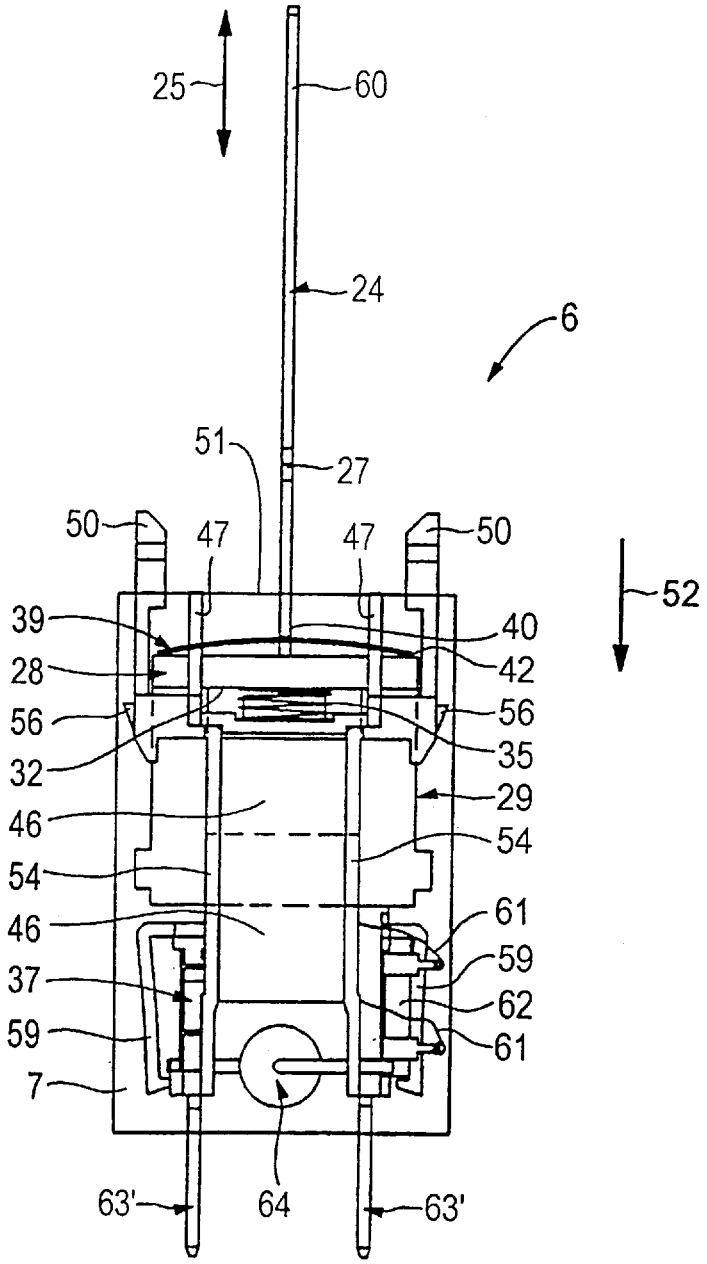
FIG. 6, a side view of the undervoltage device in the direction of the arrow VI in FIG. 5.

The coil body 37 shown in two parts in FIG. 2 has a coil 46 schematically shown in FIG. 4 through FIG. 6. The two parts 37' of the coil body 37 each have two guide webs 47 extending approximately in the direction of motion of the magnet armature 28. The guide webs 47 are integrally formed onto the coil body 37 and in the assembled state of the magnetic circuit protrude past the pole faces 31 in the dropping direction of the magnet armature 28. A guide web 47 of the part 37' is aligned in the crosswise direction 26 with a guide web 47 of the second part 37'. These two aligned guide webs 47 flank the magnet armature 28 on both sides and thus force a linear motion of the magnet armature 28 in the displacement direction 25. To improve the motion guidance, a second pair of two guide webs 47 is formed, with parallel spacing, onto the coil body 37. The free ends of the guide webs 47, oriented toward the fixing slide 24, have a stop dog 48 for limiting the travel distance of the dropping magnet armature 28. To that end, the stop dogs 48 of the two guide webs 47 aligned with one another in the crosswise direction 26 are aimed at one another and act upon the end face 33 of the dropping magnet armature 28 (FIG. 4).

The dividing plane of the coil body 37 is at the same time its plane of symmetry, since the two parts 37' and 37' are embodied identically. The plane of the U of the magnet core 29 is located approximately in the dividing plane of the coil body 37. The part 37' has a receiving groove 49 whose opening is toward the magnet core 29. This receiving groove 49 is defined in the displacement direction 25 by a plurality of groove webs 49*a*. On assembly of the electromagnet, the two parts 37' are aimed toward one another in the crosswise direction 26 and with their receiving grooves 49 they receive the connecting yoke 30 of the magnet core 29 approximately positively between them. As a result, the magnet core 29 is mechanically stably fixed to the coil body 37.

Also formed onto each part 37' are two spring hooks 50, spaced apart from one another crosswise to the plane of motion of the fixing slide 24. In the assembled state of the coil body 37, one spring hook 50 of the first part 37' is aligned in the crosswise direction 26 with one spring hook 50 of the second part 37'. The put-together coil body 37 is inserted through an insertion opening 51 along an insertion direction 52 into the parallelepiped device housing 7 and is locked to the device housing 7 in detent fashion. To that end, the insides of the two side walls of the device housing 7, which walls extend crosswise to the plane of motion of the fixing slide 24, each have two mounting grooves 53, of which only the two mounting grooves 53 of the one side wall are visible in FIG. 2, because of the perspective view. The two mounting groups 53 of each side wall extend, spaced apart parallel from one another, in the insertion direction 52. They correspond with corresponding mounting webs 54 of the parts 37'. The plane of these guide webs 54 is defined by the insertion direction 52 and the crosswise direction 26. They enable easy assembly and exact positioning of the electromagnet in the device housing 7. For stationary positioning of the coil body 37 in the device housing 7, the two side walls of the device housing 7, which extend parallel to the plane of motion of the fixing slide 24, are each pierced with two detent holes 55. These detent holes 55 correspond with correspondingly embodied detent protrusions 56 (FIG. 2) formed onto the parts 37'.

In the assembled state of the coil body 37, the spring hooks 50 protrude past the insertion opening 51 of the device housing 7. For the sake of easy detent locking, in terms of mounting, of the undervoltage device 6 to the circuit breaker 1, the spring hooks 50 engage corresponding detent webs 57 from behind in the direction of the switch bottom 23 (FIG. 3 through FIG. 5). In the detent position of the spring hooks 50, the insertion opening 51 of the device housing 7 is automatically covered toward the outside by a cap wall 58 of the switch housing 2 that is disposed in the region of the switch bottom 23. The fixing slide 24 connected to the magnet armature 28 protrudes past the insertion opening 51 of the device housing 7. When the device housing 7 is mounted on the circuit breaker 1, the fixing slide 24 passes in the displacement direction 25 through a wall opening in the top wall 58 and plunges into the switch housing 2. The fixing slide 24 plunges into the rocker (FIG. 3 through FIG. 5) with a rodlike free end 60 protruding past the bearing shoulder 27 in the displacement direction 25.

The coil terminals 61 of the coil 46 are electrically conductively connected (FIG. 6) via a bridge rectifier 62 to two device connection contacts 63' (or 63", FIG. 7) of the undervoltage device 6 that are connected to the voltage to be monitored. A series resistor 64 is also inserted into the electrical circuit between the bridge rectifier 62 and the device connection contacts 63'. In the assembled state, the bridge rectifier 62 is clampingly fixed in captive fashion between a spring-elastic clamp outrigger 59, formed onto the part 37', and the part 37' itself.

Figure 7:
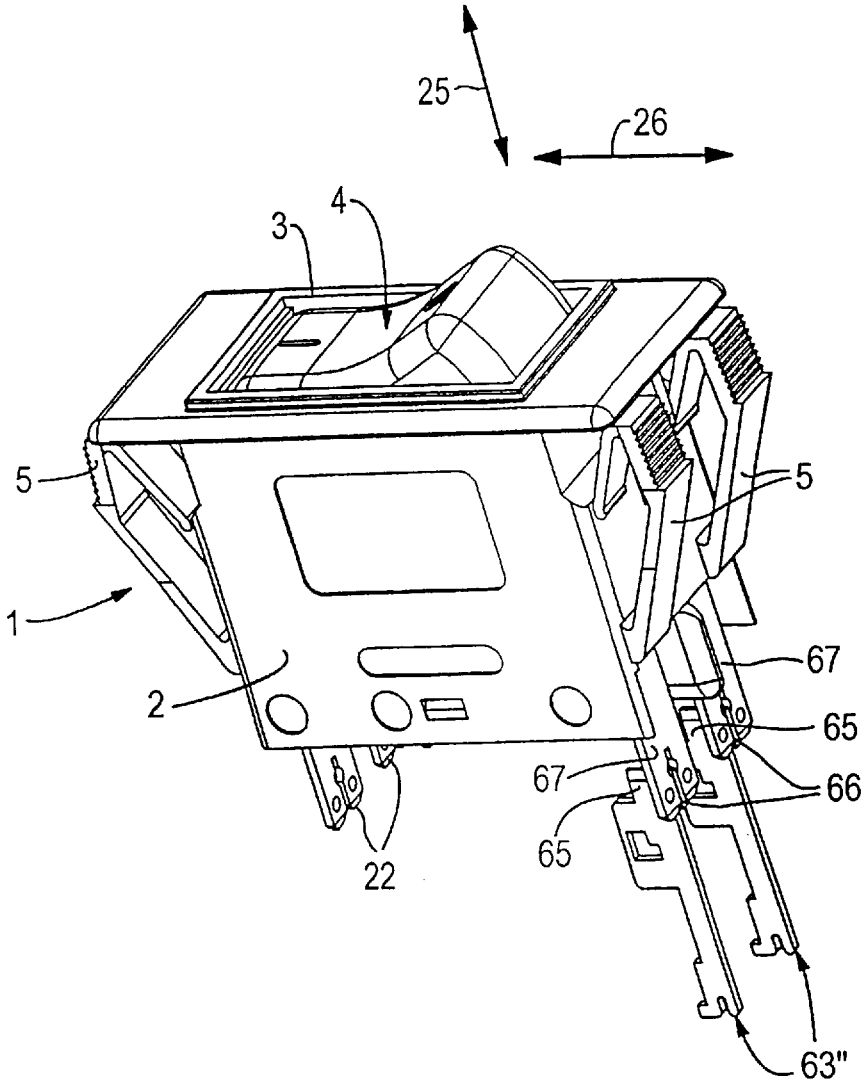
FIG. 7, the perspective view of the excess-current circuit breaker of FIG. 1 with a further embodiment of device contact terminals of the undervoltage device for electrical connection to a voltage.

For the device connection contacts, two embodiments are contemplated. In a first embodiment, two device connection contacts 63' protrude in the insertion direction 52 past the device housing 7 (FIGS. 1, 2, 3, 5, 6) and are directly electrically connected to the voltage—not shown here—that is to be monitored. In a second embodiment, two device connection contacts 63" are disposed entirely inside the device housing 7 (FIG. 4, FIG. 7). In this embodiment, the undervoltage device 6 is electrically connected directly to terminals of the circuit breaker 1. To that end, the free ends, toward the circuit breaker 1, of the device connection contacts 63" are embodied as flat contact tongues 65. These contact tongues 65 correspond with contact slits 66, extending in the displacement direction 25, of two switch connection contacts 67. By aids not shown in further detail here, the mains supply line is connected, particularly by screwing, to the two switch connection contacts 67. The two contact slits 66 are dimensioned such that when the undervoltage device 6 is secured to the circuit breaker 1, the contact tongues 65 engage the contact slits 66 and are clampingly fixed by them with the requisite electrical contact pressure.

The functional principle of the circuit breaker 1 combined with the undervoltage device 6 will now be explained: Upon excess current, the breaker mechanism or switch mechanism of the circuit breaker 1 is shifted into a contact opening position that interrupts the current circuit, and the rocker 4 is shifted to its OFF position (FIG. 5). The rocker 4 shifted to its OFF position acts, with its actuation side 68 toward the user, on the free end 60 of the fixing slide 24 in the displacement direction 25. As a result, the magnet armature 28 is held on the magnet core 29 (equals closed magnetic circuit), regardless of how high the voltage applied to the device connection contacts 63' and 63" is (FIG. 5).

In the ON position of the rocker 4, the free end 60 of the fixing slide 24 is decoupled from the rocker 4 and is freely movable relative to the rocker (FIG. 3). In this case, the positioning of the fixing slide 24 is dependent solely on the position of the magnet armature 28. The magnet armature is retained on the magnet core 29 (equals closed magnetic circuit as in FIG. 3) solely by the voltage applied to the device connection contacts 63' or 63"). If the voltage drops below a certain value, then the retention force of the electromagnet does not suffice to keep the magnet armature 28 in its attracted position. The magnet armature 28 is therefore pressed in the dropping direction, or in other words in the direction of the rocker 4, by spring pressure of the helical spring 34. The fixing slide 24 coupled to the magnet armature 28 is displaced in the displacement direction 25 toward the actuation side 68 of the rocker 4 (FIG. 4). In the process, the bearing shoulder 27 of the fixing slide 24 urges the tripping lever 15 counterclockwise, thus shifting the breaker mechanism—as already described—to the contact opening position. The rocker 4, here pivoting into its OFF position with the aid of a rotary spring not shown, automatically acts with its actuation side 68 upon the fixing slide 24 and displaces it in the displacement direction 25 toward the magnet core 29 (FIG. 5). Hence this always automatically closes the magnetic circuit in the OFF position of the rocker 4, even if the voltage required to keep the magnet armature 28 on the magnet core 29 has not yet been reapplied to the device connection contacts 63 or 63".

Once the requisite voltage has again been applied, then the magnetic circuit is already closed the next time the circuit breaker 1 is turned on (equals shifting of the rocker 4 to its ON position). The electromagnet need therefore generate only the requisite retention force for the magnet armature 28. Conversely, if the requisite voltage has not yet been applied again, then the magnetic circuit is automatically opened if the attempt is made to shift the rocker 4 to its ON position. As a result, the bearing shoulder 27 acts upon the tripping lever 17, thus forcing the breaker mechanism into its contact opening position. The rocker 4 can therefore not be transferred to its ON position, and the circuit breaker 1 cannot be turned on, as long as the requisite voltage has not yet been applied again to the device connection contacts 63' or 63".

Figure 8:
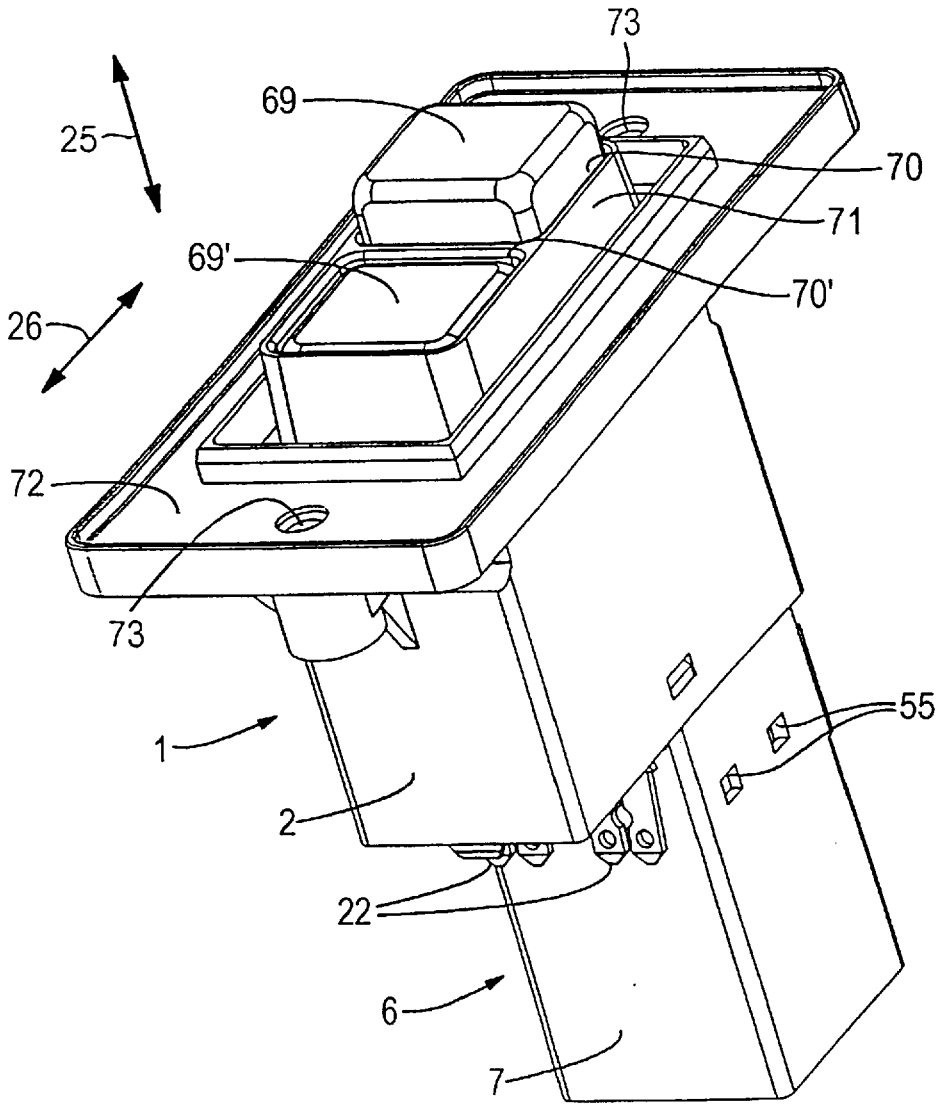
FIG. 8, a perspective view of an excess-current circuit breaker containing two pushbuttons as the switching device, with a undervoltage device secured to it.

In FIG. 8, a further exemplary embodiment of the circuit breaker 1 is shown, with two pushbuttons 69, 69' as the switching device. Functionally identical components are identified in FIG. 8 with the same reference numerals as in FIG. 1 through FIG. 7. The two push buttons 69, 69' for switching the current circuit are displaceable in the displacement direction 25 and each positively passes through one guide recess 70, 70'. The two guide recesses 70, 70' are a component of a shaftlike guide attachment 71 formed onto the switch housing. The guide attachment 71 is surrounded by an assembly baffle 72, which likewise forms a part of the switch housing 2 and which is pierced in the displacement direction 25 by two circular mounting holes 73. The mounting holes 73 serve to receive suitable fastening means, such as screws, with whose aid the circuit breaker 1 is fixed in stationary fashion at the mounting site.

The mechanical coupling of the two pushbuttons 69, 69' to one another in order to switch the current circuit can be done in principle in the way known from International Patent Application WO-A 94 07 255. The fixing slide 24, not shown in FIG. 8, is coupled to the pushbutton 69 in such a way that in the OFF position of the circuit breaker 1 or of the pushbutton 69, the fixing slide 24 assumes the position visible in FIG. 5. The free end 60 of the fixing slide 24 then is preferably located in a hoodlike receiving opening of the pushbutton 69 and pressure is exerted on it by the pushbutton in the direction of the magnet core 29. In a further embodiment, not shown, only a single pushbutton is contemplated as the switching device and coupled in a suitable way to the fixing slide 24.

I claim:

1. An electrical switch having a switching device, movable between an ON position and an OFF position, for switching a current circuit on and off and having a magnetic circuit for electromagnetic undervoltage tripping, said magnetic circuit includes a magnet armature and a magnet core, wherein upon undervoltage, the magnetic circuit as it opens shifts the switching device to its OFF position, and wherein the switching device shifted into its OFF position closes the magnetic circuit comprising a linearly movable fixing slide, coupling the switching device to the magnet armature, for fixing the magnet armature to the magnet core in the OFF position of the switching device.

2. The switch of claim 1, wherein the fixing slide is decoupled from the switching device located in its ON position.

3. The switch of claim 1, wherein the fixing slide has a bearing shoulder, which extends crosswise to the displacement direction of the fixing slide and which, when the magnet armature is dropping, acts upon a breaker mechanism, connected to the switching device, for opening a switch contact of the current circuit and for shifting the switching device into its OFF position.

4. The switch of claim 1, further comprising a spring element, disposed between the fixing slide and the magnet armature, for adjusting the fixing slide between the switching device and the magnet armature.

5. The switch of claim 4, further comprising a spring disk, braced on the magnet armature and curved in an arc, which on its concave side is oriented toward the magnet armature.

6. The switch of claim 1, wherein the magnet armature is connected to the fixing slide in captive fashion.

7. The switch of claim 6, wherein the magnet armature has an armature slit for receiving a fixation tang, which is disposed on the fixing slide and engages an edge of the armature slit from behind.

8. The switch of claim 1, wherein the displacement direction of the fixing slide extends parallel to the dropping direction of the magnet armature and/or is located in the plane of motion of the switching device.

9. The switch of claim 1, wherein said fixing slide is a platelike fixing slide.

10. The switch of claim 1, wherein the magnetic circuit further includes an electromagnet and further comprising a coil body which carries a coil of the electromagnet, said coil body has at least two guide webs, protruding past a pole face of the magnet core in the dropping direction of the magnet armature, which webs, facing one another, as a motion guide, laterally flank the magnet armature.

11. The switch of claim 10, wherein the guide webs each have one stop dog oriented toward one another crosswise to the dropping direction.

12. The switch of claim 1, wherein the magnet core is horseshoe-shaped and has two pole faces and the magnet armature, for closing the magnetic circuit, is contacted with both pole faces of the horseshoe-shaped magnet core.

13. The switch of claim 12, wherein the magnetic circuit further includes an electromagnet and further comprising a coil body which carries a coil of the electromagnet said coil body is in two parts, with the dividing plane as its plane of symmetry.

14. The switch of claim 13, wherein the plane of the U of the horseshoe-shaped magnet core is located approximately in the dividing plane of the coil body.

15. The switch of claim 1, wherein the magnetic circuit further includes an electromagnet and further comprising a coil body which carries a coil of the electromagnet, said coil body being inserted into a device housing and fixed there, and a switch housing wherein the coil body has spring hooks which in an assembled state of the switch protrude past an insertion opening of the device housing and correspond with corresponding detent recesses of the switch housing.

16. The switch of claim 15 wherein the insertion opening of the device housing is sealed off from the outside, in the detent position of the spring hooks, by a cap wall of the switch housing.

* * * * *